US006051078A

United States Patent [19]

Naito et al.

[11] Patent Number: 6,051,078

[45] Date of Patent: Apr. 18, 2000

[54] METHOD AND APPARATUS FOR CONTROLLING THE ATMOSPHERE IN HEAT TREATMENT FURNACE

[75] Inventors: Takeshi Naito; Kouichi Ogihara; Akihiro Wakatsuki; Tadanori Nakahiro; Hideki Inoue; Yoshio Nakashima, all of Tokyo, Japan

[73] Assignee: Dowa Mining Co., Ltd., Tokyo, Japan

[21] Appl. No.: 09/024,049

[22] Filed: Feb. 16, 1998

[30] Foreign Application Priority Data

Feb. 18, 1997 [JP] Japan ..... 9-048597

[51] Int. Cl.[7] ..... C23C 8/20; C23C 8/22

[52] U.S. Cl. ..... 148/215; 148/216; 148/235; 266/251; 266/252

[58] Field of Search ..... 148/215, 216, 148/235; 266/251, 252

[56] References Cited

U.S. PATENT DOCUMENTS 2,886,478 5/1959 Beard ..... 148/216

FOREIGN PATENT DOCUMENTS 54931 9/1978 Japan .

159567 12/1984 Japan .

243754 10/1987 Japan ..... 148/216

63260 7/1990 Japan .

648654 2/1979 Russian Federation ..... 148/216

*Primary Examiner*—Deborah Yee

*Attorney, Agent, or Firm*—Nilles & Nilles SC

[57] ABSTRACT

In a method of and apparatus for controlling an atmosphere in a heat treatment furnace according to the present invention, a carburizing is carried out while supplying a hydrocarbon series gas and an oxidization gas into the furnace, and the supply of the hydrocarbon series gas is stopped either when the quantity of a residual $CH_4$ in the furnace is changed to increasing from decreasing, or when a partial pressure of oxygen in the furnace reaches a predetermined value.

9 Claims, 2 Drawing Sheets

METHOD AND APPARATUS FOR CONTROLLING THE ATMOSPHERE IN HEAT TREATMENT FURNACE

BACKGROUND OF THE INVENTION

1. Field of the Invention

This invention relates to a method and apparatus for controlling an atmosphere in a heat treatment furnace, and more particularly relates to a method and apparatus for controlling an atmosphere in a heat treatment furnace for carrying out a gas carburizing, carbonitriding or bright controlled atmosphere heat treatment, etc.

2. Description of the Prior Art

In conventional heat treatment methods, such as gas carburizing of metals, a mixture of a hydrocarbon gas and air is converted into an endothermic gas through the use of an endothermic type converted gas generator. The endothermic gas is introduced into the furnace, and an enriched hydrocarbon gas is added to the furnace in order to obtain a predetermined carbon potential.

However, recently, in order to enhance the quality, and to reduce the treatment time and running cost, gas generators are no longer desirable. Rather, introducing a hydrocarbon series gas and an oxidizing gas are directly into the furnace to carry out the carburizing in the furnace has been proposed.

Such a method is described in Japanese Patent Applications Laid-Open Nos. 54931/1979, 159567/1986 and 63260/1992.

However, the carburizing speed in the direct carburizing method is varied on a large scale according to the carburizing time and the diffusion time. In the carburizing time, the main effect is the direct decomposition of the hydrocarbon gas, etc. (raw gas) and in the diffusion time, the main effect is the Boundouard reaction.

In the carburizing time, the degree of the decomposition varies due to the quantity of the hydrocarbon gas to be introduced directly into the furnace and the temperature of the atmosphere in the furnace as well as the type of goods to be treated in the furnace. As a result, hydrocarbon gas in excess of the amount required for carburizing is piled as soot in the furnace, thereby potentially subjecting the goods to be treated to soot.

If the heat treatment is carried out in the sooting range, the service life of the oxygen sensor becomes reduced.

SUMMARY OF THE INVENTION

Accordingly, an object of the present invention is to obviate the above defects.

A further object of the present invention is to provide a method of controlling an atmosphere in a heat treatment furnace comprising the steps of carrying out a carburizing while supplying a hydrocarbon gas and an oxidization gas into a furnace, and stopping the supply of the hydrocarbon gas when the quantity of a residual $CH_4$ in the furnace is changed to increasing from decreasing.

Another object of the present invention is to provide a method of controlling an atmosphere in a heat treatment furnace comprising the steps of carrying out a carburizing while supplying a hydrocarbon gas and an oxidization gas into a furnace, and stopping the supply of the hydrocarbon gas when the partial pressure of oxygen in the furnace reaches a predetermined value.

A further object of the present invention is to provide an apparatus for controlling an atmosphere in a furnace comprising a furnace, a heater for heating the inside of the furnace, means for measuring a partial pressure of oxygen and a partial pressure of $CH_4$ in the furnace, means for introducing a hydrocarbon series gas and an oxidization gas into the furnace, and means for controlling the quantities of the hydrocarbon series gas and the oxidization gas to be introduced into the furnace.

The hydrocarbon gas contains a hydrocarbon for its main ingredient, and comprises acetylene, methane, propane or butane gas. Methane, propane, or butane gas is preferred.

In a preferred embodiment of the present invention, the oxidization gas is air or $CO_2$ gas.

The forgoing and other objects, features, and advantages of the present invention will become apparent from the following more particular description of preferred embodiments of the invention, as illustrated in the accompanying drawings.

DESCRIPTION OF THE PREFERRED EMBODIMENT

Figure 1:
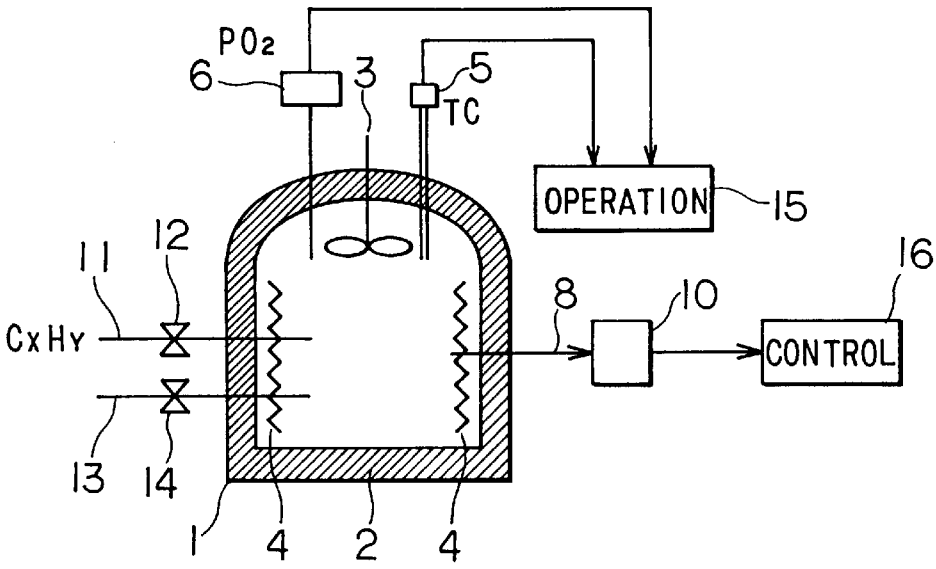
FIG. 1 is a view illustrating a method and apparatus for controlling an atmosphere in a heat treatment furnace in accordance with a preferred embodiment of the present invention.

FIG. 1 shows a control apparatus for a heat treatment furnace according to the present invention.

In FIG. 1, reference numeral 1 denotes a shell of furnace, 2 denotes a refractory brick forming the shell of furnace 1, 3 denotes a fan for recirculating the atmosphere in the furnace, 4 denotes a heater, 5 denotes a thermocouple for controlling the temperature in the furnace, 6 denotes a zirconian type sensor for sensing the partial pressure of a solid electrolyte oxygen, for example, which is inserted directly into the furnace, 8 denotes a tube for measuring the partial pressure of $CH_4$, 10 denotes an analyzer for analyzing the partial pressure of $CH_4$, 11 denotes a pipe for introducing hydrocarbon gas into the furnace, 12 denotes a control valve inserted into the pipe 11, 13 denotes a pipe for introducing oxidization gas into the furnace, 14 denotes a control valve inserted into the pipe 13, 15 denotes an operating apparatus for the carbon potential, and 16 denotes a controller for supplying control signals to the valves 12 and 14.

Figure 2:
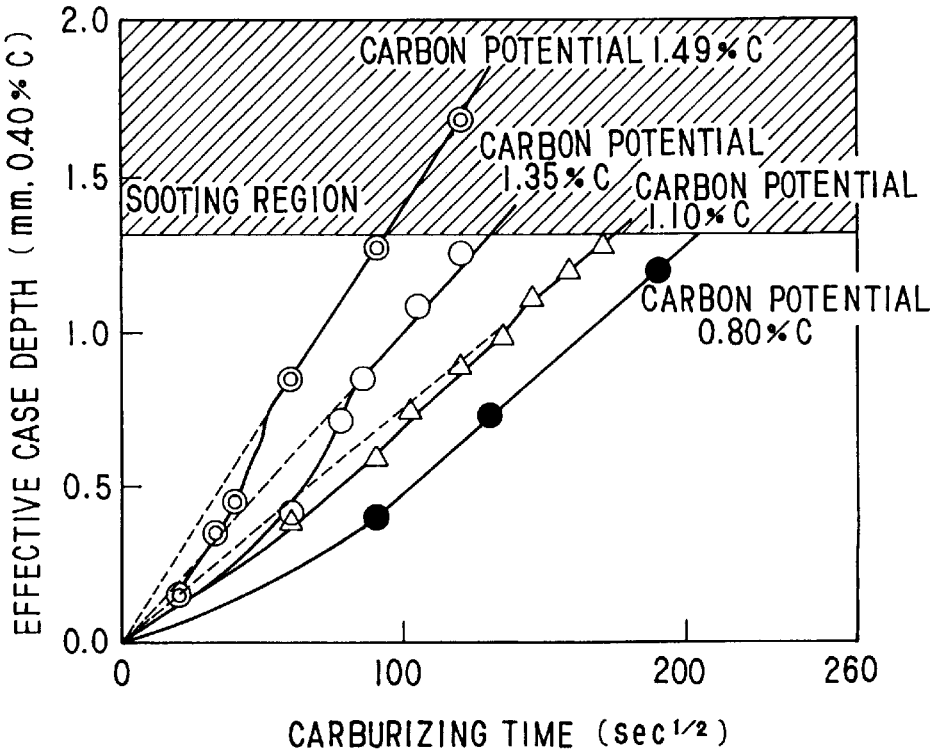
FIG. 2 is a graph of carbon potential as a function of effective case depth and carburizing time.

FIG. 2, shows the relationship between the effective case depth and the carburizing time according to the carbon potential.

As shown in FIG. 2, it is publicly known that if the carbon potential in the carburizing time is higher, the carburizing can be completed with a shorter time period and that it is not suitable to carry out the heat treatment in the hatched sooting region of the Fe-C series equilibrium diagram shown in FIG. 2.

Figure 3:
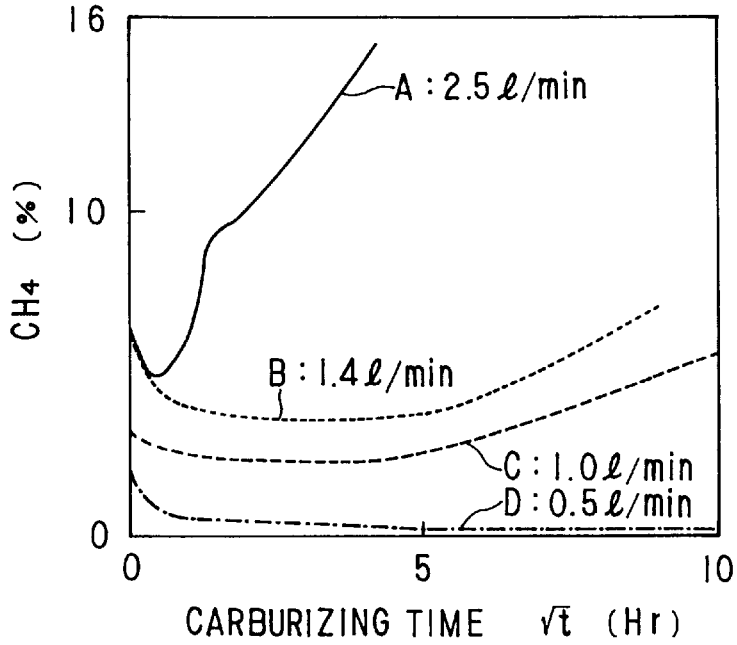
FIG. 3 is a graph of added enriched gas as a function of CH4 percentage and carburizing time.

It is better to add a large quantity of enriched gas (hydrocarbon gas) in order to increase the carbon potential. Referring to FIG. 3, if the goods to be treated are 150 kg, and if $C_4H_{10}$ gas of 2.5 liter/minute is introduced (case A), $C_4H_{10}$ gas of 1.4 liter/minute is introduced (case B), and $C_4H_{10}$ gas of 1.0 liter/minute is introduced (case C), the quantity of residual $CH_4$ is decreased and then increased with time, thereby inducing sooting. However, in the case when $C_4H_{10}$ gas of 0.5 liter/minute is introduced (case D), the quantity of residual $CH_4$ is constant substantially, so that the goods are not sooted. It is considered that in the cases of (A), (B)and (C), the quantity of added $C_4H_{10}$ gas is large and accordingly some carbon cannot be absorbed by the steel, so that the quantity of undecomposed residual $CH_4$ is increased, but in case of (D), the entire carbon content can be absorbed by the steel. Accordingly, the sooting can be prevented by analyzing and controlling the quantity of residual $CH_4$.

In the present invention, therefore, the quantity of residual $CH_4$ is analyzed by the analyzer 10 and when the quantity of residual $CH_4$ is changed to increasing from decreasing the control valve 12 is closed to stop the supply of the hydrocarbon series gas $C_x H_y$, so that the quantity of residual $CH_4$ is prevented from being increased.

As apparent from the Fe-C series equilibrium diagram, the sooting can be prevented by measuring and controlling the partial pressure of oxygen corresponding to the maximum carbon solid solution, because the maximum carbon solid solution is constant at a specific temperature.

In the present invention, accordingly, the output value of the sensor 6 for sensing the partial pressure of oxygen is measured to determine the partial pressure of oxygen, and the control valve 12 is closed when the partial pressure of oxygen reaches a predetermined value, in order to prevent the sooting from occurring.

Furthermore, in the present invention, the control valve 12 can be closed at an earlier time either when the partial pressure of oxygen reaches a predetermined value or the partial pressure of $CH_4$ reaches a predetermined value by carrying out the measurements of the partial pressure of oxygen and the measurement of the partial pressure of $CH_4$ at the same time.

(Embodiment 1)

A batch furnace is used, the goods to be treated of approximately 150 kg are introduced into the furnace, and the carburizing operation is carried out for approximately four hours at approximately 930° C. by using $C_4H_{10}$ gas as a hydrocarbon series gas and $CO_2$ gas as an oxidization gas.

As shown in FIG. 3, the quantity of $CH_4$ increases with time when more than approximately 1.0 liter/minute of butane is added as the hydrocarbon gas. This means that the residual $CH_4$ is undecomposed and accumulated in the furnace, so that the sooting is accelerated.

Figure 4:
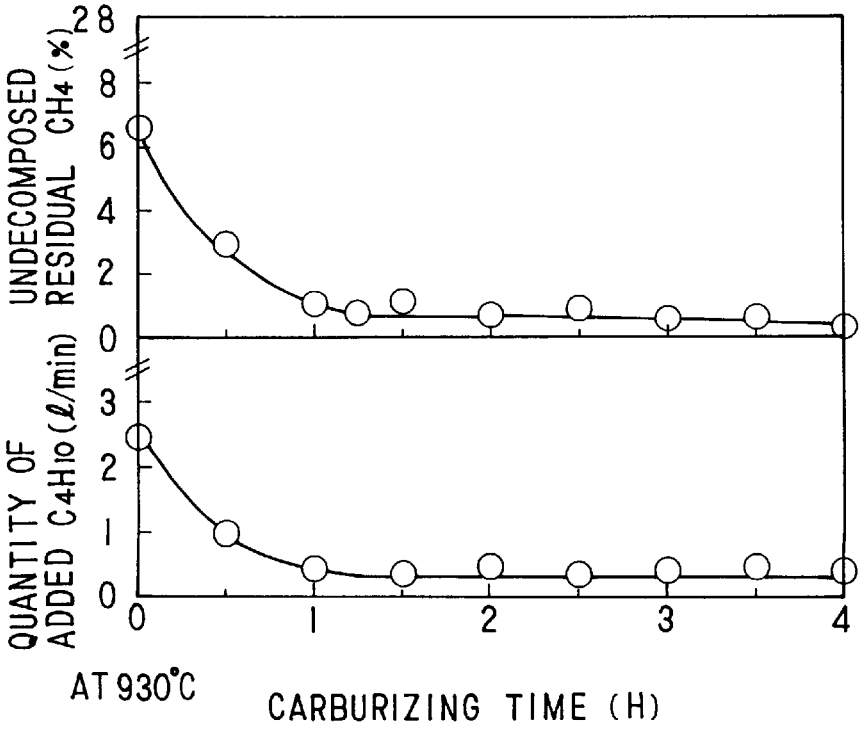
FIG. 4 is a graph of the quantity of residual CH4 and added C4H10 as a function of carborizing time.

FIG. 4 shows the relationship between the quantity of residual $CH_4$ in the furnace and the quantity of added $C_4H_{10}$ according to the carburizing time, in the case that no sooting occurs. It is apparent from FIG. 4 that the sooting occurs when the hydrocarbon gas is added at 2.5 liter/minute, but the sooting can be prevented from occurring if the introduction of the hydrocarbon gas is controlled according to the present invention.

The hydrocarbon gas contains a hydrocarbon for its main ingredient, and comprises acetylene, methane, propane or butane gas. Methane, propane, or butane gas is preferred.

Air or $CO_2$ gas is used as the oxidization gas.

As stated above, according to a preferred embodiment of the present invention, the sooting can be prevented from occurring in advance by controlling the quantity of hydrocarbon series gas to be added according to the partial pressure of $CH_4$ and partial pressure of oxygen in the atmosphere of the heat treatment for the gas carburizing, carbonitriding or bright heat treatment.

While the invention has been particularly shown and described with reference to the preferred embodiments thereof, it will be understood by those skilled in the art that various changes in form and details may be made therein without departing from the spirit and scope of the invention as defined by the appended claims.

What is claimed is:

1. A method of controlling an atmosphere in a heat treatment furnace comprising:

carburizing while supplying a hydrocarbon gas and an oxidation gas into a furnace; and stopping the supply of the hydrocarbon gas when the quantity of a residual CH4 in the furnace is changed to increasing from decreasing.

2. A method of controlling an atmosphere in a heat treatment furnace comprising:

carburizing while supplying a hydrocarbon gas and an oxidization gas into a furnace; and stopping the supply of the hydrocarbon gas when a partial pressure of oxygen in the furnace reaches a value corresponding to a maximum carbon solid solution obtainable in the furnace at a prevailing temperature within the furnace.

3. The method of controlling an atmosphere in a heat treatment furnace as claimed in claim 1, further comprising stopping the supply of the hydrocarbon gas when one of 1) the residual CH4 is changed to increasing from decreasing and 2) the partial pressure of oxygen in the furnace reaches a value corresponding to a maximum carbon solid solution obtainable in the furnace at a prevailing temperature within the furnace.

4. The method of controlling an atmosphere in a heat treatment furnace as claimed in claim 1, wherein the hydrocarbon gas contains hydrocarbon as its main ingredient, and comprises one of acetylene, methane, propane and butane.

5. The method of controlling an atmosphere in a heat treatment furnace as claimed in claim 1, wherein the oxidization gas is air or $CO_2$ gas.

6. A control apparatus for controlling an atmosphere in a furnace, comprising: a heater for heating the inside of the furnace, means for measuring a partial pressure of oxygen and a partial pressure of CH4 in the furnace, means for supplying a hydrocarbon gas and an oxidization gas into the furnace, means for controlling quantities of the hydrocarbon gas and the oxidization gas to be supplied into the furnace, and means for stopping the supply of the hydrocarbon gas when the quantity of a residual CH4 in the furnace is changed to increasing from decreasing.

7. The control apparatus for controlling an atmosphere in a furnace as claimed in claim 6, wherein the hydrocarbon gas contains hydrocarbon as its main ingredient, and comprises one of a group containing acetylene, methane, propane and butane.

8. The control apparatus for controlling an atmosphere in a furnace as claimed in claim 6, wherein the oxidization gas comprises one of air and CO2 gas.

9. In combination:

(A) a furnace; and (B) a control apparatus for controlling an atmosphere in the furnace, the control apparatus including a heater for heating an inside of the furnace, means for measuring a partial pressure of oxygen and a partial pressure of CH4 in the furnace, means for supplying a hydrocarbon gas and an oxidization gas into the furnace, means for controlling the quantities of the hydrocarbon gas and the oxidization gas to be supplied into the furnace, and means for stopping the supply of the hydrocarbon gas when the partial pressure of oxygen in the furnace corresponds to a maximum carbon solid solution obtainable in the furnace at a prevailing temperature within the furnace.

* * * * *